US007485048B2

(12) United States Patent
Nilsson et al.

(10) Patent No.: US 7,485,048 B2
(45) Date of Patent: Feb. 3, 2009

(54) GOLF CLUB DEVICE

(75) Inventors: Johnny Nilsson, Täby (SE); Jon Karlsen, Horten (NO); Arnulf Larsgård, Holmestrand (NO)

(73) Assignee: Devilray AS (NO)

( * ) Notice: Subject to any disclaimer, the term of this patent is extended or adjusted under 35 U.S.C. 154(b) by 43 days.

(21) Appl. No.: 10/524,611

(22) PCT Filed: Aug. 15, 2003

(86) PCT No.: PCT/NO03/00277

§ 371 (c)(1),
(2), (4) Date: Aug. 24, 2005

(87) PCT Pub. No.: WO2004/016326

PCT Pub. Date: Feb. 26, 2004

(65) Prior Publication Data

US 2006/0122005 A1 Jun. 8, 2006

(30) Foreign Application Priority Data

Aug. 16, 2002 (NO) ..... 20023882

(51) Int. Cl.
*A63B 53/10* (2006.01)
*A63B 53/12* (2006.01)
*A63B 53/04* (2006.01)
*A63B 53/02* (2006.01)

(52) U.S. Cl. ..... 473/256; 473/292; 473/316; 473/289; 473/349; 473/256; 473/305

(58) Field of Classification Search ..... 473/324–350, 473/305–315, 256, 297, 287–292, 412
See application file for complete search history.

(56) References Cited

U.S. PATENT DOCUMENTS 3,017,186 A * 1/1962 Ascardi ..... 273/108

(Continued)

FOREIGN PATENT DOCUMENTS

EP 0 255 324 2/1988

(Continued)

OTHER PUBLICATIONS

IPEA Opinion, Sep. 13, 2004.

(Continued)

*Primary Examiner*—Sebastiano Passaniti
(74) *Attorney, Agent, or Firm*—Andrus, Sceales, Starke & Sawall, LLP

(57) ABSTRACT

A golf club device, more specifically a putter (1), comprising a head (2) and a shaft (3) attached to the head (2), the free end of the shaft (3) possibly being provided with a grip, wherein the moment of mass inertia of the head (2) constitutes less than seventy-nine per cent of the total moment of inertia of the putter (1) when the putter (1) is rotated about an axis of rotation (4), which is perpendicular to the longitudinal axis (7) of the shaft (3) and about one hundred and twenty centimeters from the longitudinal axis (5) of the head (2), and/or wherein the mass of the shaft, including a possible displaceable weight (11), divided by the length of the shaft is at least one hundred and seventy grams per meter of shaft in a shaft which is up to one meter long, and at least one hundred and ninety grams per meter of shaft in a shaft which is longer than one meter.

6 Claims, 1 Drawing Sheet

U.S. PATENT DOCUMENTS

| | | | | | |
|---|---|---|---|---|---|
| 3,578,325 | A | * | 5/1971 | Teas | 273/317 |
| 3,614,101 | A | * | 10/1971 | Hunter | 473/301 |
| 3,698,239 | A | * | 10/1972 | Everett, III | 73/65.03 |
| 3,814,430 | A | * | 6/1974 | Leumi | 273/118 R |
| 3,881,733 | A | * | 5/1975 | Csernits | 473/330 |
| 3,909,005 | A | * | 9/1975 | Piszel | 473/248 |
| 4,058,312 | A | * | 11/1977 | Stuff et al. | 473/287 |
| 4,203,598 | A | | 5/1980 | Stuff et al. | |
| 4,588,191 | A | | 5/1986 | Stewart | |
| 4,674,746 | A | * | 6/1987 | Benoit | 473/297 |
| 5,082,279 | A | * | 1/1992 | Hull et al. | 473/242 |
| 5,090,698 | A | * | 2/1992 | Kleinfelter | 473/313 |
| 5,131,656 | A | * | 7/1992 | Kinoshita | 473/341 |
| 5,244,209 | A | * | 9/1993 | Benzel | 473/297 |
| 5,269,518 | A | * | 12/1993 | Kobayashi et al. | 473/297 |
| 5,306,008 | A | | 4/1994 | Kinoshita | |
| 5,324,032 | A | * | 6/1994 | Minami | 473/320 |
| 5,364,102 | A | * | 11/1994 | Appledorn | 473/297 |
| 5,377,979 | A | * | 1/1995 | Long | 473/310 |
| 5,447,310 | A | * | 9/1995 | Jernigan | 473/330 |
| 5,460,378 | A | * | 10/1995 | Getts | 473/251 |
| 5,554,078 | A | * | 9/1996 | Hannon et al. | 473/292 |
| 5,692,969 | A | * | 12/1997 | Schooler | 473/313 |
| 5,772,525 | A | * | 6/1998 | Klein | 473/300 |
| 5,865,687 | A | * | 2/1999 | Alzano | 473/313 |
| 6,083,116 | A | | 7/2000 | Loredo | |
| 6,213,890 | B1 | | 4/2001 | Prince | |
| 6,506,128 | B1 | * | 1/2003 | Bloom, Jr. | 473/292 |
| 6,511,387 | B2 | * | 1/2003 | Grieb | 473/330 |
| 2001/0005696 | A1 | * | 6/2001 | Hedrick | 473/318 |
| 2006/0019765 | A1 | * | 1/2006 | Plutt | 473/297 |

FOREIGN PATENT DOCUMENTS

| | | |
|---|---|---|
| GB | 2305614 | 4/1997 |
| WO | WO 01/47611 | 7/2001 |

OTHER PUBLICATIONS

Applicant's Reply to Opinion, Nov. 11, 2004.
Search Report dated Jan. 28, 2003, in Norwegian priority Application No. 2002 3882, now Norwegian Patent No. 316,426.

* cited by examiner

GOLF CLUB DEVICE

CROSS REFERENCE TO RELATED APPLICATION

The present application is the U.S. national stage application of International Application PCT/NO02003/000277, filed Aug. 15, 2003, which international application was published on Feb. 26, 2004 as International Publication WO 2004/016326. The International Application claims priority of Norwegian Patent Application 20023882, filed Aug. 16, 2002.

BACKGROUND OF THE INVENTION

The invention relates to a golf club device, more specifically a so-called putter, which is used to hit the golf ball the last distance to a hole.

A putter is used in order to hit a golf ball a relatively short distance, typically from a few millimeters to about thirty meters. The putter is arranged with a club face, which is nearly perpendicular relative to the ground surface when the putter hits the ball, in order for the ball to roll along the ground.

Golf clubs that are used in competition, must have a configuration in accordance with the rules that apply to the game of golf. Technical solutions are known, which may help the player to achieve optimal strokes, but the set of rules allows limited freedom of action in terms of technical means.

Known optimization of golf clubs includes variations in the angle of the club face, the mass and shape of the club head, the mass, shape and rigidity of the shaft, the position of the center of gravity of the club head relative to the position of the shaft attachment and the point where the face is to hit the ball, etc.

In putting it is most important that the ball is hit in such a way that it gets the right initial velocity and direction in order for the ball just to reach the hole. The initial velocity is affected by three conditions: the velocity of the club head as it hits the ball, the effective mass of the putter and the position of the hitting point on the face of the club head.

Given the effective mass of the putter, it is the player's ability to control the velocity of the club head and the hitting point that distinguishes a good putt from a not so good putt. The greatest transmission of energy from club to ball is achieved when the hitting point on the face of the club head is on the course of the centre of gravity of the club head. With minor variations, a good player will place the hitting point correctly, players practicing to get it to be the same from one stroke to the other. To a trained player the greatest challenge is therefore to get the right velocity for the club head, so that the ball gets the right initial velocity.

When putting is performed by wrist rotation, the player grips the club with both hands at the free end of the shaft and holds the club right in front of himself as he is bending forward. By a rotation of the wrists, the club is rotated about an essentially horizontal axis of rotation at the wrists, and the stroke is performed without the back and the shoulder portion moving. When putting is performed by a rotation of the vertebral column, the club is gripped in a way corresponding to that in wrist rotation, but the stroke movement is achieved by a rotation of the upper body about the vertebral column. The club rotates about an essentially horizontal axis at the height of the top of the vertebral column. Experienced golfers prefer to perform a putt by rotation of the vertebral column. Wrist putting is more common among novices.

A putt normally requires very little energy, a small part of a trained player's stroke capacity is involved. More often than not, putts are carried out at a very low club velocity. It is difficult to adjust the transmission of energy in the stroke. To increase the stability of the putter in the stroke, known putters have a light shaft and a relatively heavy club head, and the development has been towards heavier and heavier club heads. The club head of a putter weighs from 250 to 500 grams, whereas the shaft typically weighs from 100 to 120 grams. An increased mass of the club head has a stabilizing effect, but it is still difficult to achieve the right initial velocity on the golf ball. This may be caused by the fact that a heavy club head means an increased active mass transmitting energy to the ball, and even small velocity differences in the moment of striking make noticeable differences in the initial velocity of the ball.

SUMMARY OF THE INVENTION

The object of the invention is to provide an improved putter.

The object is realized through features as specified in the description below and the following claims.

A putter according to the invention is stabilized by the shaft having a large mass compared to that of known putters, either by the shaft making up a larger part and the club head a smaller part of the moment of mass inertia of the putter about a defined axis of rotation, than in a known putter, or by the mass of the shaft per unit of length being larger than in a known putter.

A putter according to a first embodiment of the invention is provided with a club head, which has an average or small mass, so that the head's part of the moment of mass inertia of the putter about the axis of rotation makes up a smaller part of the total moment of mass inertia of the putter than in known putters.

A putter according to a second embodiment of the invention is provided with a shaft which has a larger mass per unit of length than known putters have.

The moment of inertia of a mass point rotating about an axis of rotation is defined as the mass of the mass point multiplied by the square of the distance between the mass point and the axis of rotation. When a body rotates about an axis of rotation, each mass point of the body will follow its own course, so that the distance of said axis of rotation can vary from one mass point to another. There is a well developed set of formulas for the calculation of the moment of inertia of bodies rotating about an axis, and this is well known to a person skilled in the art. Therefore, the theoretical basis for the moment of inertia and calculations associated with it, will not be explained in further detail.

A putter according to the invention may have a club head of any mass. A typical putter can have a club head with a mass in the range of 225 to 350 grams and a shaft with a mass in the range of 150 to 1500 grams or more. At the free end of the shaft there is arranged, in a known manner, a grip with a mass in the range of 56 to 141 grams. According to a first embodiment of the invention the club head makes up less than 80 percent of the moment of inertia of the club when the club rotates about an axis of rotation perpendicular to the shaft and at a distance of about 120 centimeters from the club head. The shaft may be provided with a displaceable mass, for example in the form of a tubular sleeve enclosing the shaft, the sleeve being arranged to be attached at a desired distance from the club head. The shaft's portion of the moment of inertia can thereby be adjusted to the player's stroke technique.

In practice the club head's portion of the moment of inertia of the putter about the axis of rotation may be between 30 and 75 percent. This is significantly different from known putters, in which the club head makes up 80 percent or more of the moment of mass inertia of the club when the club is rotated about a rotational axis as indicated.

The mass of the shaft may be determined through the choice of material and the dimensioning. Additional masses may also be provided in the form of weights or filling substance in a tubular shaft. The additional mass may be displaceable longitudinally of the shaft, for example a displaceable weight arranged either on the shaft or within a tubular shaft. The moment of inertia of the shaft about the axis of rotation, may be adjusted to a preferred value through displacement of the weight.

According to the invention, the connection between the head and shaft of the putter may advantageously be formed as a connection of limited elasticity. As the head of the putter hits the ball, said elastic connection contributes to that mainly the mass of the head gives the ball its initial velocity, whereas the mass of the shaft will be less important.

As mentioned, the purpose of the invention can be realized through a putter according to a second embodiment of the invention, more specifically by means of a shaft of a relatively large mass per unit of length. The total mass of the shaft comprises the shaft and a possible displaceable weight. More specifically, the total mass of the shaft divided by the length of the shaft should be at least 170 grams per meter of shaft in shafts shorter than 1 meter, and at least 190 grams per meter of shaft in shafts longer than 1 meter.

BRIEF DESCRIPTION OF THE DRAWINGS

The invention will be described in further detail below by means of an exemplary embodiment, and reference is made to the attached drawings, in which.

DETAILED DESCRIPTION OF THE INVENTION

Figure 1:
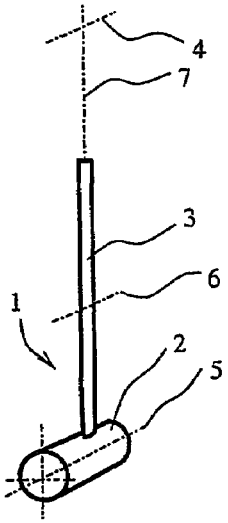
FIG. 1 shows in perspective a generalized putter with a cylindrical shaft.
Figure 2:
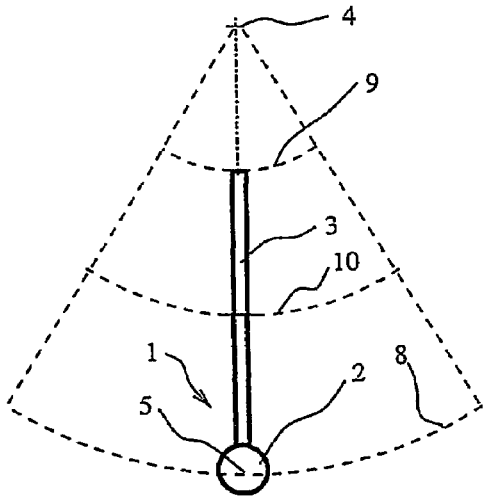
FIG. 2 shows a front view of the putter of FIG. 1.

In FIG. 1 the reference numeral 1 identifies a generalized putter comprising a head and a cylindrical shaft 3 attached to the head 2. FIGS. 1 and 2 will be used to support reflections connected to the moment of mass inertia of the putter 1 and how it is divided between the head 2 and the shaft 3. To simplify the description, moment of inertia is used instead of moment of mass inertia below. At the free end of the shaft 1 a grip is arranged in a known manner, but this has not been shown as it affects the reflections to a small degree and is not of importance to the conclusions.

In FIGS. 1 and 2 the head 2 and the shaft 3 have been simplified to a massive straight cylindrical shape to simplify the following reflection on the moment of inertia of the putter 1.

In a stroke, the putter 1 is rotated about an essentially horizontal axis of rotation 4 located about 120 centimeters from the axis 5 of the club head 2. The length of the head 2 has been chosen to be 12 centimeters and the diameter has been chosen to be 3 centimeters. A great number of heads of greatly varying shapes are known. For a given mass, a cylindrical shape with the specified dimensions represents a putter head with a low moment of inertia about the longitudinal axis. The distance between the axis of rotation 4 and the longitudinal axis 5 of the head 2 will vary with the player's height and manner of playing.

The diameter of the shaft 3 has been chosen to be 1 centimeter. The length of the shaft 3 has been chosen to be 88 centimeters, which corresponds to a good thirty-four inches.

A transversal axis 6 halfway along the length of the shaft 3 is thereby 75 centimeters from the axis of rotation 4 and 45 centimeters from the axis 5 of the club head.

The structure of the generalized putter 1 has otherwise been chosen to be such that the axis of rotation 4, the longitudinal axis 5 of the head and the transversal axis 6 of the shaft are perpendicular to the longitudinal axis 7 of the shaft 3.

In a stroke the putter 1 is rotated like a pendulum, approximately as suggested in broken lines in FIG. 2, in which the head 2 describes an arc 8, whereas the free end of the shaft 3 describes an arc 9 and the center of the shaft 3 describes an arc 10.

The mass of the shaft 3 has been set at 0.15 kilograms, which is considered to be representative of a known putter. The mass of the head 2 has a great effect on the moment of inertia of the putter 1. Therefore, it is reasonable to look at the division of the moment of inertia between the head 2 and the shaft 3 for two values of the mass of the head 2, the selected values representing extreme values for a traditional putter, namely 0.25 and 0.5 kilograms respectively.

According to Steiner's theorem, the moment of inertia of the head 2 about the axis of rotation 4 is given by the sum of the moment of inertia of the head 2 about the longitudinal axis 5 of the head and the moment of inertia of the center of gravity of the head 2 about the axis of rotation 4. Correspondingly, the moment of inertia of the shaft 3 about the axis of rotation 4 is given by the sum of the moment of inertia of the shaft 3 about the transversal axis 6 and the moment of inertia of the center of gravity of the shaft 3 about the axis of rotation 4. With the indexes h for the head and s for the shaft, the moment of inertia I can be expressed through formulas as given below, in which the letters m, d, l and a indicate mass, diameter, length and distance to the axis of rotation, respectively.

$$I_h = \frac{m_h}{2}\frac{d_h^2}{4} + m_h a_h^2 = m_h\left(\frac{d_h^2}{8} + a_h^2\right)$$

$$I_s = \frac{m_s}{12}\left(\frac{3}{4}d_s^2 + l_s^2\right) + m_s a_s^2 = m_s\left(\frac{d_s^2}{16} + \frac{l_s^2}{12} + a_s^2\right)$$

By inserting the numerical values $d_h$=3 cm, $l_h$=12 cm, $a_h$=120 cm for a first head 2 having a mass $m_h$=0.25 kg and for a second head 2 having a mass $m_h$=0.5 kg, it can be seen that for a known putter 1 the moment of inertia of the head 2 about the axis of rotation 4 will be in the range of 3600-7200 kgcm$^2$.

For the shaft 3 are used, correspondingly, $d_s$=1 cm, $l_s$=88 cm, $a_s$=75 cm and mass $m_s$=0.15 kg, which gives a moment of inertia of the shaft 3 about the axis of rotation 4 equalling 941 kgcm$^2$.

Thus, the total moment of inertia $I=I_h+I_s$ of a known putter 1 will be in the range of 4541-8141 kgcm$^2$ when the head 2 weighs from 0.25 to 0.5 kg. Thereby, the head 2 makes up 79-88 percent of the total moment of inertia.

For a putter 1 according to the invention, the head 2 will constitute a smaller portion, and the shaft 3 will constitute a larger portion of the total moment of inertia of the putter 1 than for a known putter.

By increasing the mass of the shaft 3 from 0.15 kg to 0.2 kg, for example, both the moment of inertia of the shaft 3 and the total moment of inertia of the putter about the axis of rotation 4 will increase. If the mass of the head 2 is 0.25 kg, the portion of the head 2 of the total moment of inertia is reduced from 79 to 74 percent. If the mass of the head 2 is 0.5 kg, the portion of the head 2 of the total moment of inertia is reduced from 88 to 85 percent.

If the mass of the shaft 3 is increased to 1.5 kg, the portion of the head 2 of the total moment of inertia about the axis of rotation 4 will be 28 and 43 percent, respectively, for a head 2 with a mass of 0.25 or 0.5 kg.

For a putter 1 according to the invention, the moment of inertia of the head 2 about the axis of rotation 4 makes up less than 79 percent of the total moment of inertia of the putter about the axis of rotation 4 when the distance between the axis of rotation 4 and the longitudinal axis 5 of the head 2 is about 120 centimeters. The head's 2 portion of the moment of inertia may advantageously be less than 75 percent.

Figure 3:
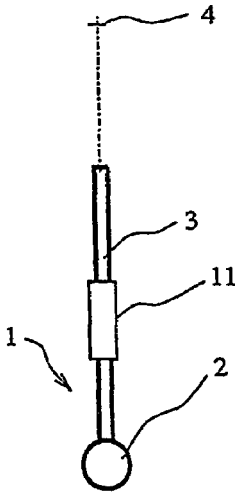
FIG. 3 shows a front view of a putter with a displaceable weight on the shaft.

In FIG. 3 is shown a putter 1, in which the shaft 3 is provided with a weight 11 arranged to be displaced along the shaft 3 and attached at a desired distance from the head 2. The weight 11 will form part of the total moment of inertia of the putter 1 about the axis of rotation 4 and thereby contribute to reduce the portion of the head 2 of the total moment of inertia. The moment of inertia of the weight 11 is determined by the mass of the weight 11 and its distance to the axis of rotation 4. Thereby, the head's 2 portion of the total moment of inertia can be adjusted through displacement of the weight 11.

Figure 4:
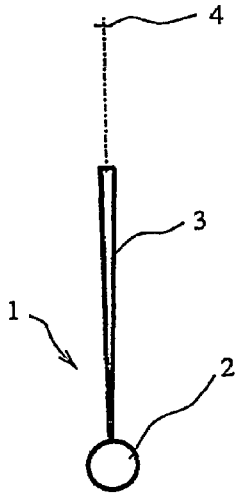
FIG. 4 shows a front view of a putter with a conical shaft.

FIG. 4 shows an embodiment of a putter 1, in which the shaft 3 is conical, so that the diameter of the shaft 3 is the largest at its free end and the smallest at the head 2. In practice the shaft 3 will be provided with a suitable grip at the free end of the shaft 3, but the grip is not shown. A conical shaft 3 will provide a different mass distribution and moment of inertia from those of a cylindrical shaft of the same mass and the same length. The moment of inertia of the conical shaft 3 about the axis of rotation 4 is lower than that of a corresponding cylindrical shaft. This is essentially due to the fact that the center of gravity of the shaft is moved closer to the free end of the shaft 3 and thereby closer to the axis of rotation 4. To maintain the head's 2 portion of the total moment of inertia, the moment of inertia of the head 2 must also be lower when a conical shaft is used, as is shown in FIG. 4. This means that the mass of the head 2 must be smaller when a conical shaft 3 is used. The shaft 3 of the putter 1 will typically have a circular cross-section, whether the shaft is cylindrical or conical, but a different cross-sectional shape can also be used.

Figure 5:
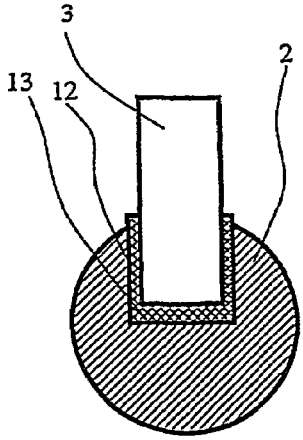
FIG. 5 shows, in a front view and on a larger scale, a section through a putter head and part of a shaft.

FIG. 5 shows a section through a head 2, in which a shaft 3 is inserted into a bore 12 of the head 2 and secured to the head 2 by an elastic material 13, which is disposed in an annular space between the head 2 and the shaft 3. The elastic material 13 may be, for example, a ring of rubber glued to the shaft 3 and to the head 2. The elastic material 13 may also be an elastic moulding substance. With an elastic connection between the head 2 and the shaft 3, the contribution from the mass of the shaft 3 in the stroke is reduced.

The invention claimed is:

1. A golf putter comprising:

a head;

a grip; and a shaft consisting of an elongated member having a unitary construction, the member having a first end coupled to the head and a second end coupled to the grip, wherein the weight of the shaft is uniformly distributed along its length between the first and second ends;

wherein the moment of mass inertia of the head constitutes less than seventy-nine percent of the combined mass of inertia of the head and the shaft when the head, shaft and grip are pivoted about a pivot axis that is generally perpendicular to the longitudinal axis of the shaft and that is situated about one hundred and twenty centimeters from the longitudinal axis of the head.

2. The golf putter of claim 1, wherein the shaft is a straight cylindrical shape and wherein the mass of the shaft is evenly distributed along the entire length of the shaft.

3. The golf putter of claim 1, wherein the shaft is a conical shape and wherein the mass of the shaft is evenly graduated along the entire length of the shaft.

4. The golf putter of claim 3, wherein the weight of the shaft increases gradually along the length of the shaft from its second end to its first end.

5. The golf putter of claim 1, wherein the moment of mass inertia of the head constitutes greater than thirty percent of the total moment of inertia of the head, the grip and the shaft.

6. The golf putter of claim 1, wherein the mass of the shaft divided by the length of the shaft is at least one hundred and seventy grams per meter of shaft in a shaft which is up to one meter long and at least one hundred and ninety grams per meter of shaft in a shaft which is longer than one meter.

* * * * *